US010910190B2

(12) United States Patent
Jeong

(10) Patent No.: US 10,910,190 B2
(45) Date of Patent: Feb. 2, 2021

(54) X-RAY TUBE

(71) Applicant: ELECTRONICS AND TELECOMMUNICATIONS RESEARCH INSTITUTE, Daejeon (KR)

(72) Inventor: Jin-Woo Jeong, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 16/734,632

(22) Filed: Jan. 6, 2020

(65) Prior Publication Data

US 2020/0227228 A1 Jul. 16, 2020

(30) Foreign Application Priority Data

Jan. 10, 2019 (KR) ..... 10-2019-0003460
Oct. 14, 2019 (KR) ..... 10-2019-0127153

(51) Int. Cl.
*H01J 35/18* (2006.01)
*H01J 35/08* (2006.01)
*H01J 35/06* (2006.01)

(52) U.S. Cl.
CPC ..... *H01J 35/186* (2019.05); *H01J 35/065* (2013.01); *H01J 35/08* (2013.01); *H01J 2235/18* (2013.01)

(58) Field of Classification Search
CPC ..... H01J 35/186; H01J 35/08; H01J 35/065; H01J 2235/18
See application file for complete search history.

(56) References Cited

U.S. PATENT DOCUMENTS 4,384,360 A * 5/1983 Kitadate ..... H05G 1/025 378/199
7,668,297 B2 2/2010 Inazuru et al.
9,941,091 B2 4/2018 Jeong et al.
2003/0002627 A1* 1/2003 Espinosa ..... H01J 35/065 378/136
2004/0202282 A1* 10/2004 Miller ..... H01J 35/16 378/140
2008/0043920 A1* 2/2008 Liu ..... H01J 35/065 378/138

(Continued)

FOREIGN PATENT DOCUMENTS

KR 101289502 B1 7/2013
KR 1020130116004 A 10/2013
KR 1020160123981 A 10/2016

*Primary Examiner* — Christine S. Kim
(74) *Attorney, Agent, or Firm* — Rabin & Berdo, P.C.

(57) ABSTRACT

An embodiment of the inventive concept provides an X-ray tube including a chamber having a hollow pillar shape using a first axis as a central axis, a cathode electrode disposed on a bottom surface of the chamber, an emitter provided at a position at which the cathode electrode meets the first axis, an anode electrode including a through-hole using the first axis as a central axis and a target layer inclined to the first axis, a gate electrode disposed between the cathode electrode and the anode electrode and having an opening exposing the emitter, a focusing electrode disposed between the gate electrode and the anode electrode, a window spaced apart from the target layer of the anode electrode, and a window electrode provided on a top surface of the chamber to fix a side surface of the window. Here, the window electrode is grounded.

20 Claims, 5 Drawing Sheets

(56) References Cited

U.S. PATENT DOCUMENTS

| | | | | |
|---|---|---|---|---|
| 2010/0202590 | A1* | 8/2010 | Freudenberger | H01J 35/16 378/140 |
| 2011/0142204 | A1* | 6/2011 | Zou | H01J 35/065 378/138 |
| 2012/0057678 | A1* | 3/2012 | Lu | H04N 5/32 378/95 |
| 2013/0336459 | A1* | 12/2013 | Choi | H01J 35/14 378/122 |
| 2016/0148778 | A1 | 5/2016 | Kang et al. | |
| 2017/0048955 | A1* | 2/2017 | Jeong | G21K 1/02 |
| 2017/0053771 | A1 | 2/2017 | Jeong et al. | |
| 2017/0111984 | A1* | 4/2017 | Kim | H01J 35/165 |

* cited by examiner

X-RAY TUBE

CROSS-REFERENCE TO RELATED APPLICATIONS

This U.S. non-provisional patent application claims priority under 35 U.S.C. § 119 of Korean Patent Application Nos. 10-2019-0003460, filed on Jan. 10, 2019, and 10-2019-0127153, filed on Oct. 14, 2019, the entire contents of which are hereby incorporated by reference.

BACKGROUND

The present disclosure herein relates to an X-ray tube, and more particularly, to a micro focus X-ray tube focusing an electron beam on a focal spot having a small size.

An X-ray tube generates an electron in a vacuum vessel and accelerates the generated electron toward an anode so that the electron collides with a metal target of the anode, thereby generating an X-ray in a bremsstrahlung method. Here, a voltage difference between an anode and a cathode is defined as an acceleration voltage that accelerates the electron, and accelerates the electron with an acceleration voltage of several kV to several hundreds kV according to the purpose of the X-ray tube. Also, the X-ray tube may further include a gate electrode and a focusing electrode between the anode and the cathode.

SUMMARY

The present disclosure provides an X-ray tube capable of obtaining a sufficient X-ray dose and a high resolution image.

The object of the present invention is not limited to the aforesaid, but other objects not described herein will be clearly understood by those skilled in the art from descriptions below.

An embodiment of the inventive concept provides an X-ray tube including: a chamber having a hollow pillar shape using a first axis as a central axis; a cathode electrode disposed on a bottom surface of the chamber; an emitter provided at a position at which the cathode electrode meets the first axis; an anode electrode including a through-hole using the first axis as a central axis and a target layer inclined to the first axis; a gate electrode disposed between the cathode electrode and the anode electrode and having an opening configured to expose the emitter; a focusing electrode disposed between the gate electrode and the anode electrode; a window spaced apart from the target layer of the anode electrode; and a window electrode provided on a top surface of the chamber to fix a side surface of the window. Here, the window electrode is grounded.

In an embodiment, the focusing electrode may be provided in plurality, and each of the focusing electrodes may have an opening configured to expose the emitter.

In an embodiment, the focusing electrodes and the gate electrode may include protruding portions provided on side surfaces thereof, respectively. Here, the protruding portions may surround the openings, respectively, and each of the protruding portions may have a thickness less than that of each of the focusing electrodes and the gate electrode.

In an embodiment, the cathode electrode may include a first portion having a plane shape perpendicular to the first axis and a second portion protruding from the first portion in a direction parallel to the first axis.

In an embodiment, the emitter may be provided on a top surface of the second portion of the cathode electrode.

In an embodiment, the X-ray tube may further include a control circuit unit connected to the first portion of the cathode electrode, and the control circuit unit may include at least one transistor to which a signal is applied.

In an embodiment, the anode electrode may include: a first portion having a plane shape perpendicular to the first axis; a second portion having a hollow pillar shape configured to surround the through-hole; a third portion provided on one portion of a top surface of the second portion. Here, the through-hole may have a lower opening defined at a central portion of the first portion, the through-hole may have an upper opening defined at a central portion of the second portion, the second portion may have a top surface inclined to a top surface of the first portion, and the target layer may be provided on a side surface of the third portion.

In an embodiment, the target layer may have a target surface parallel to the side surface of the third portion, and the target surface may be inclined to the first axis.

In an embodiment, the target layer may include at least one of tungsten (W) or molybdenum (Mo).

In an embodiment, the window electrode may include: a first portion having a plane shape perpendicular to the first axis; a second portion disposed between the first portion and the top surface of the chamber; and a third portion extending from the second portion in a direction parallel to the first axis. Here, the first portion may surround the window, and the third portion may be spaced apart from a side surface of the chamber.

In an embodiment, the window may have a thickness less than that of the first portion, and an extended length of the third portion in the direction parallel to the first axis may be greater than that of the second portion in the direction parallel to the first axis.

In an embodiment, the window may include at least one of beryllium (Be), copper (Cu), aluminum (Al), or molybdenum (Mo).

In an embodiment, the chamber may include an aluminum oxide ($Al_2O_3$).

In an embodiment of the inventive concept, an X-ray tube includes: a chamber having a hollow pillar shape; a cathode electrode disposed on a bottom surface of the chamber; an emitter provided on the cathode electrode and configured to emit an electronic beam in a direction perpendicular to a top surface of the cathode electrode; a gate electrode having a first opening through which the electronic beam passes; a first focusing electrode having a second opening through which the electronic beam passes; a second focusing electrode having a third opening through which the electronic beam passes; an anode electrode including a through-hole through which the electronic beam passes and a target layer configured to collide with the electronic beam to emit an X-ray; a window through which the X-ray is discharged to the outside of the chamber; and a window electrode configured to fix a side surface of the window. Here, a width of the second opening is greater than a width of the third opening.

In an embodiment, centers of the first to third openings, a central axis of the through-hole, and a center of the target layer may be aligned on a path of the electronic beam perpendicular to the top surface of the cathode electrode.

In an embodiment, the anode electrode may be fixed to a side surface of the chamber, the target layer may be provided on a side surface of one portion of the anode electrode, and the target layer may have a target surface inclined to a path of the electronic beam perpendicular to the top surface of the cathode electrode.

In an embodiment, the window may be spaced apart from the target layer, the window may have a vertical thickness less than that of the window electrode, and the window electrode may be grounded.

In an embodiment, the window electrode may cover a top surface of the chamber, and the window electrode may include one portion extending in a direction toward the cathode electrode in the chamber. Here, the one portion may be spaced apart from a side surface of the chamber, and the one portion may have a bottom surface disposed at a level lower than the top surface of the chamber.

In an embodiment, the gate electrode, the first focusing electrode, and the second focusing electrode may include first to third protruding portions configured to surround the first to third openings, respectively, and the gate electrode, the first focusing electrode, and the second focusing electrode may be spaced apart from each other.

In an embodiment, the gate electrode, the first focusing electrode, the second focusing electrode, and the anode electrode may be connected to first to fourth voltage sources, respectively, and the fourth voltage source may have a higher voltage than each of the first to third voltage sources.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Figure 1:
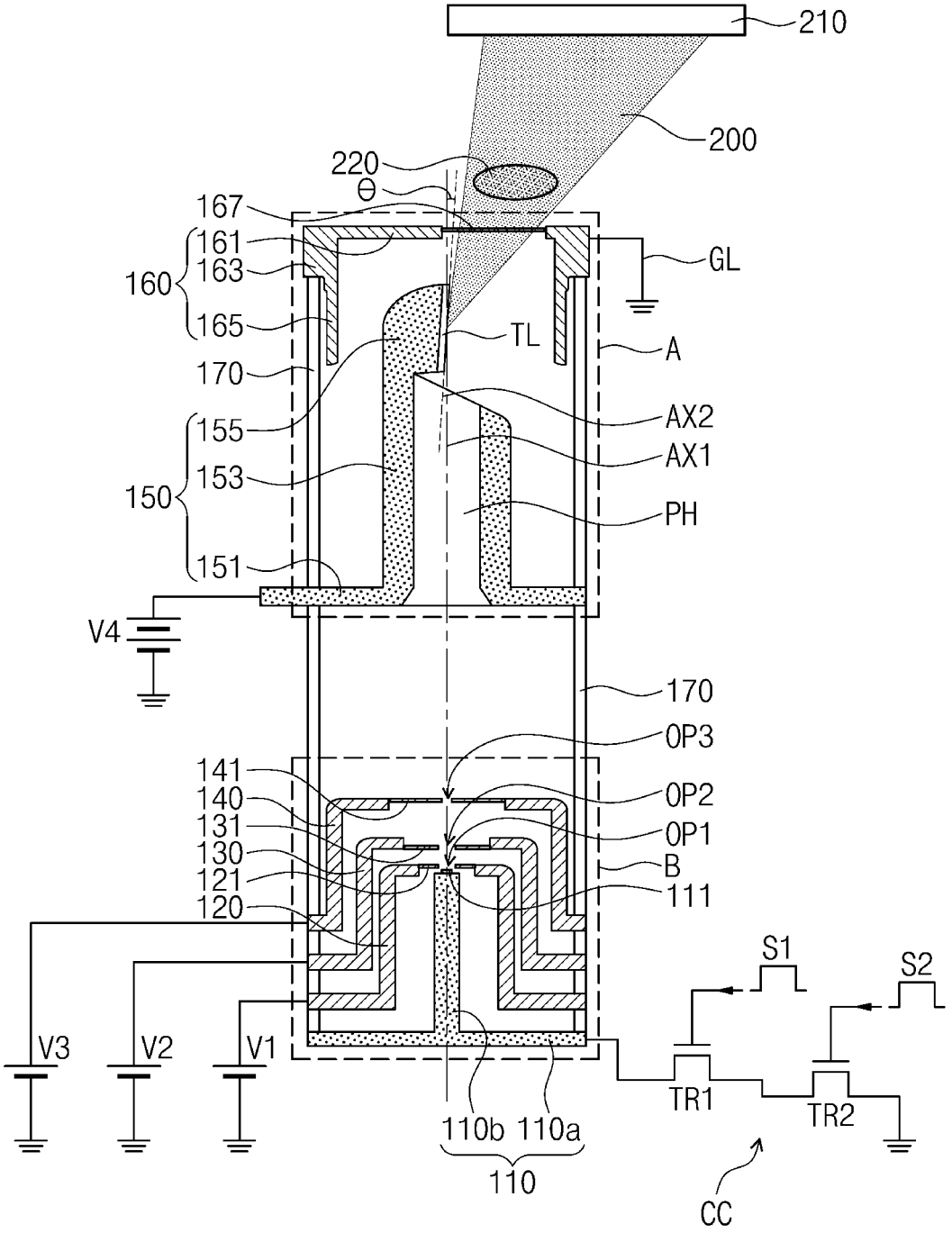
FIG. 1 is a cross-sectional view illustrating a structure of an X-ray tube according to an embodiment of the inventive concept.

Exemplary embodiments of the present invention will be described with reference to the accompanying drawings so as to sufficiently understand constitutions and effects of the present invention.

The present invention may, however, be embodied in different forms and should not be construed as limited to the embodiments set forth herein. Rather, these embodiments are provided so that this disclosure will be thorough and complete, and will fully convey the scope of the present invention to those skilled in the art. Further, the present invention is only defined by scopes of claims. In addition, the sizes of the elements and the relative sizes between elements may be exaggerated for clarity of illustration.

In the following description, the technical terms are used only for explaining a specific exemplary embodiment while not limiting the present disclosure. Unless terms used in embodiments of the present invention are differently defined, the terms may be construed as meanings that are commonly known to a person skilled in the art.

The terms of a singular form may include plural forms unless referred to the contrary. The meaning of 'comprises' and/or 'comprising' specifies a component, a step, an operation and/or an element does not exclude other components, steps, operations and/or elements.

It will also be understood that when a layer is referred to as being "on" another layer or substrate, it can be directly on the other layer or substrate, or intervening layers may also be present.

It will be understood that although the terms first and second are used herein to describe various elements, these elements should not be limited by these terms. These terms are used only to discriminate one region or layer from another region or layer. Therefore, a portion referred to as a first portion in one embodiment can be referred to as a second portion in another embodiment. An embodiment described and exemplified herein includes a complementary embodiment thereof. Like reference numerals refer to like elements throughout.

Hereinafter, embodiments of an X-ray tube according to an embodiment of the inventive concept will be described in detail with reference to FIGS. 1 to 4.

FIG. 1 is a cross-sectional view illustrating a structure of the X-ray tube according to an embodiment of the inventive concept.

Referring to FIG. 1, the X-ray tube according to an embodiment of the inventive concept may include a cathode electrode 110, an emitter 111, a gate electrode 120, first and second focusing electrodes 130 and 140, an anode electrode 150, a window electrode 160, a window 167, and a chamber 170.

The cathode electrode 110 may be disposed on a bottom surface of the chamber 170. The cathode electrode 110 may include a first portion 110*a* covering the bottom surface of the chamber 170 and a second portion 110*b* protruding form the first portion 110*a*. The first portion 110*a* may have a top surface perpendicular to a first axis AX1. The first portion 110*a* may be electrically connected to a control circuit unit CC. The control circuit unit CC may include at least one transistor. For example, the control circuit unit CC may include a first transistor TR1 and a second transistor TR2. The first portion 110*a* and the first and second transistors TR1 and TR2 may be series-connected to each other. Each of the first and second transistors TR1 and TR2 may be, e.g., a metal oxide semiconductor field effect transistor (MOSFET). A first signal S1 and a second signal S2 may be applied through a gate of each of the first and second transistors TR1 and TR2. Each of the first signal S1 and the second signal S2 may have a voltage equal to or less than about 10 V. However, unlike as illustrated, the second transistor TR2 may not be provided. The second portion 110*b* may extend in parallel to the first axis AX1. For example, the second portion 110*b* may have a pillar shape using the first axis AX1 as a central axis.

The emitter 111 may be disposed on the second portion 110*b* of the cathode electrode 110. For example, the emitter 111 may be disposed at a position at which the second portion 110*b* of the cathode electrode 110 and the first axis AX1 meet. The emitter 111 may emit an electronic beam in a direction perpendicular to a top surface of the cathode electrode 110. The electronic beam may have an emitted direction parallel to the first axis AX1.

Each of the gate electrode 120, the first focusing electrode 130, and the second focusing electrode 140 may be fixed to a side surface of the chamber 170. The gate electrode 120, the first focusing electrode 130, and the second focusing electrode 140 may include a first protruding portion 121, a second protruding portion 131, and a third protruding portion 141, respectively. First to third openings OP1, OP2, and OP3 may be provided at positions surrounded by the first to third protruding portions 121, 131, and 141, respectively. The first to third openings OP1, OP2, and OP3 may expose the emitter 111. The gate electrode 120, the first focusing electrode 130, and the second focusing electrode 140 may be electrically connected to first to third voltage sources V1, V2, and V3, respectively. The first to third voltage sources V1, V2, and V3 may control potentials of the gate electrode 120, the first focusing electrode 130, and the second focusing electrode 140, respectively. According to the potentials of the gate electrode 120, the first focusing electrode 130, and the second focusing electrode 140, whether the electron beam is emitted and a path of the electron beam may be controlled. The gate electrode 120, the first focusing electrode 130, and the second focusing electrode 140 will be described in detail later with reference to FIG. 4.

The anode electrode 150 may be spaced apart from the cathode electrode 110, the gate electrode 120, and the first and second focusing electrodes 130 and 140. The anode electrode 150 may be fixed to the side surface of the chamber 170. The anode electrode 150 may include a first portion 151, a second portion 153, a third portion 155, a target layer TL, and a through-hole PH. The first portion 151 of the anode electrode 150 may be electrically connected to a fourth voltage source V4. The fourth voltage source V4 may control a potential of the anode electrode 150. The potential of the anode electrode 150, which is controlled by the fourth voltage source V4, may be greater than that of the cathode electrode 110. Also, the fourth voltage source V4 may have a higher voltage than each of the first to third voltage sources V1, V2, and V3. Thus, the electron beam emitted from the emitter 111 of the cathode electrode 110 may be accelerated until reached to the anode electrode 150 by the potential difference. The through-hole PH may be an empty space using the first axis AX1 as a central axis. The target layer TL may have a center that is aligned with centers of the first to third openings OP1, OP2, and OP3 and the central axis of the through-hole PH. The electron beam emitted from the emitter 111 may travel in a path passing through the centers of the first to third openings OP1, OP2, and OP3 and the central axis of the through-hole PH and reached to the center of the target layer TL.

The window electrode 160 and the window 167 may be provided on a top surface of the chamber 170. The window electrode 160 may include a first portion 161, a second portion 163, and a third portion 165. The first portion 161 of the window electrode 160 may fix the window 167. The window 167 may allow an X-ray 200 emitted from the target layer TL of the anode electrode 150 to pass therethrough. The window electrode 160 may be grounded through a ground line GL. Structures of the anode electrode 150 and the window electrode 160 will be described in detail later with reference to FIGS. 2, 3A, and 3B.

The chamber 170 may have a hollow pillar shape using the first axis AX1 as a central axis. The chamber 170 may include an insulating material. For example, the chamber 170 may include an aluminum oxide ($Al_2O_3$). The chamber 170 may surround the cathode electrode 110, the gate electrode 120, the first and second focusing electrodes 130 and 140, and the anode electrode 150. The bottom surface of the chamber 170 may be covered by the cathode electrode 110. Also, the top surface of the chamber 170 may be covered by the window 167 and the window electrode 160. The inside of the chamber 170 may have a high vacuum state. Since the high vacuum state in the chamber 170 is maintained, the electron beam emitted from the emitter 111 may travel to the target layer TL of the anode electrode 150 along the first axis AX1 without being scattered.

A detector 210 and a subject 220 may be disposed on a path of the X-ray 200 emitted through the window 167. The subject 220 may be disposed between the window 167 and the detector 210. The subject 220 may be spaced apart from the window 167 and the detector 210. As the detector 210 is spaced apart from the subject 220, an X-ray image transmitted through the subject 220 may be magnified. As the X-ray image transmitted through the subject 220 is analyzed, a micro-structure inside the subject 220 may be precisely inspected without breaking the subject 220. Also, as the window 167 is grounded through the ground line GL, a distance between the detector 210, the subject 220, and the window 167 may be minimized. Also, a distance between the subject 220 and the anode electrode 150 may be minimized. As the distance between the detector 210, the subject 220, and the window 167 and the distance between the subject 220 and the anode electrode 150 are minimized, the X-ray tube according to an embodiment of the inventive concept may obtain a sufficient X-ray dose and a high resolution image.

Figure 2:
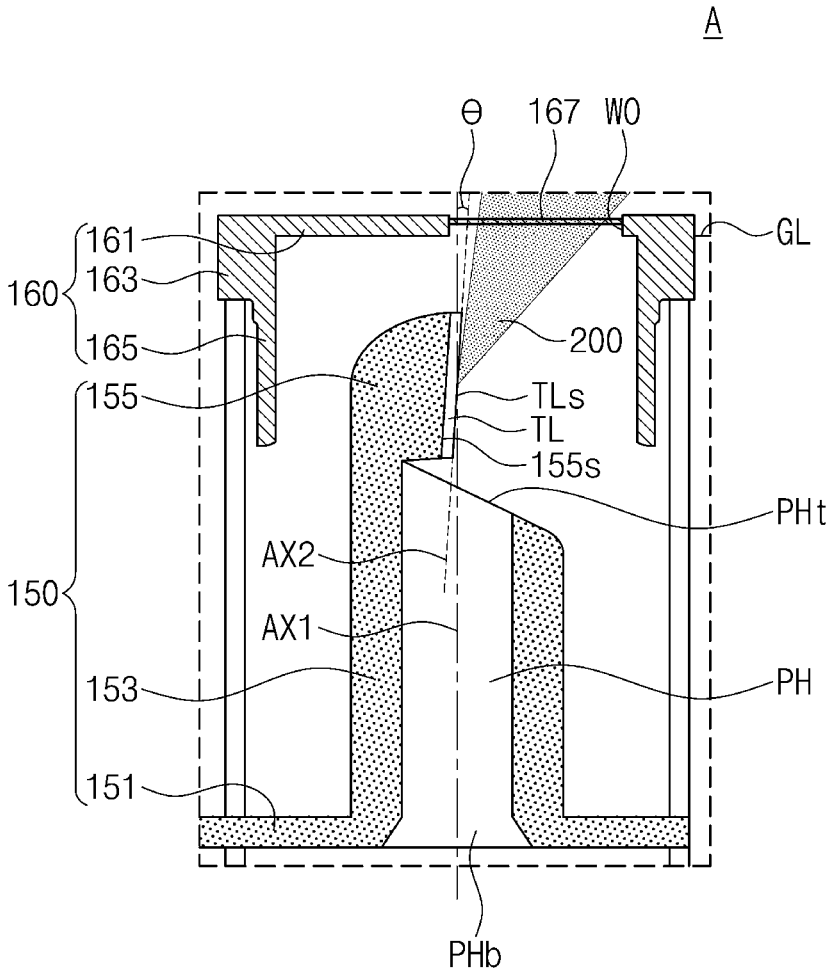
FIG. 2 is an enlarged cross-sectional view illustrating a portion A of FIG. 1.
Figure 3A:
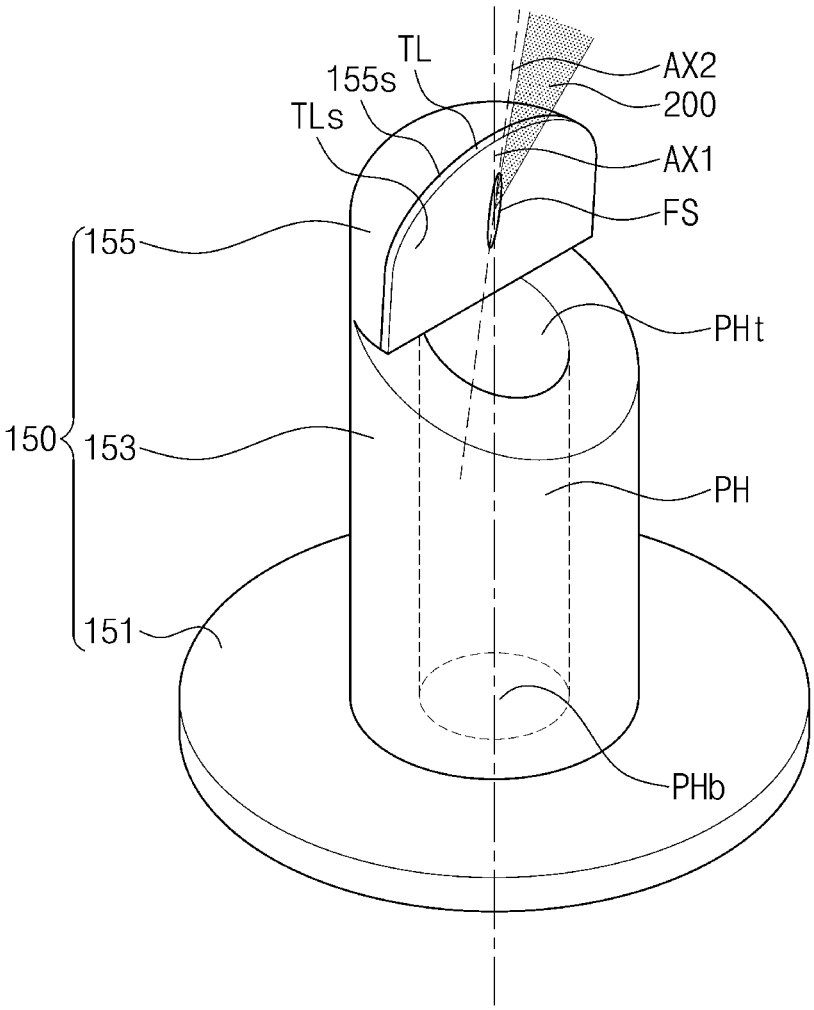
FIGS. 3A and 3B are enlarged perspective views for specifically explaining an anode electrode of the X-ray tube according to an embodiment of the inventive concept.
Figure 3B:
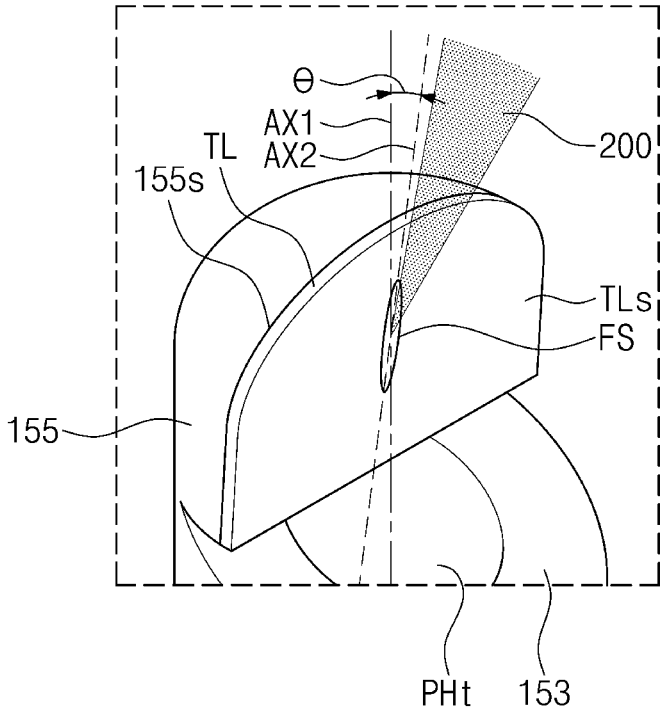

FIG. 2 is an enlarged cross-sectional view illustrating a portion A of FIG. 1. FIG. 3A is an enlarged perspective view for specifically explaining the anode electrode of the X-ray tube according to an embodiment of the inventive concept. FIG. 3B is an enlarged perspective view for specifically explaining a portion of the anode electrode of the X-ray tube according to an embodiment of the inventive concept.

Referring to FIGS. 2, 3A, and 3B, the anode electrode 150 may include the first portion 151, the second portion 153, the third portion 155, the target layer TL, and the through-hole PH.

The first portion 151 of the anode electrode 150 may have a plane shape perpendicular to the first axis AX1. The first portion 151 may be fixed to the side surface of the chamber 170. The through-hole PH may have a lower opening PHb defined at a central portion of the first portion 151. The lower opening PHb of the through-hole PH may have a width that gradually decreases in an upward direction.

The second portion 153 of the anode electrode 150 may have a hollow pillar shape surrounding the through-hole PH. The second portion 153 may extend vertically along a side surface of the through-hole PH from the first portion 151. The second portion 153 may have a top surface inclined to a top surface of the first portion 151. That is, the top surface of the second portion 153 may have different heights from the first portion 151 according to a position thereof. The through-hole PH may have an upper opening PHt defined at a central portion of the top surface of the second portion 153. The upper opening PHt of the through-hole PH may be inclined to the top surface of the first portion 151, like the top surface of the second portion 153.

The third portion 155 of the anode electrode 150 may be disposed on one portion of the top surface of the second portion 153. The one portion of the top surface of the second portion 153, which contacts the third portion 155, may have a greatest height from the first portion 151. The third portion 155 may have a side surface 155*s* parallel to a second axis AX2. The second axis AX2 may provide a first angle θ with the first axis AX1. The target layer TL may be disposed on the side surface 155*s* of the third portion 155. For example, the target layer TL may include at least one of tungsten (W) and molybdenum (Mo). The target layer TL may have a target surface TLs parallel to the second axis AX2. The second axis AX2 may extend on the target surface TLs of the target layer TL. That is, the target surface TLs of the target layer TL may be parallel to the side surface 155*s* of the third portion 155. Each of the first axis AX1 and the second axis AX2 may meet a center of the target surface TLs of the target layer TL. A focal spot FS may be provided around the center of the target surface TLs, at which the first axis AX1 and the second axis AS2 meet. The focal spot FS may be a spot at which a focused electronic beam meets the target surface TLs. As illustrated in FIGS. 3A and 3B, the focal spot FS may have an oval shape using the second axis AX2 as a central axis. As the electronic beam collides with the focal spot FS, the X-ray 200 may be emitted from the target layer TL. The X-ray 200 may be emitted in directions inclined to the second axis AX2.

The window electrode 160 may include the first portion 161, the second portion 163, and the third portion 165.

The first portion 161 of the window electrode 160 may have a plane shape perpendicular to the first axis AX1. A window opening WO may be defined at a portion of the first portion 161. The window 167 may be disposed inside the window opening WO. The first portion 161 may surround the window 167. That is, the first portion 161 may fix a side surface of the window 167. The window 167 may be spaced apart from the target layer TL of the anode electrode 150. The window 167 may have a vertical thickness less than that of the first portion 161 of the window electrode 160. Hereinafter, a vertical direction may be a direction parallel to the first axis AX1. The window 167 may include metal. For example, the window 167 may include at least one of beryllium (Be), copper (Cu), aluminum (Al), and molybdenum (Mo). The X-ray 200 emitted from the target layer TL may be discharged to the outside of the chamber 170 through the window 167.

The second portion 163 of the window electrode 160 may extend from the first portion 161 toward the top surface of the chamber 170. The second portion 163 may have a horizontal thickness greater than that of the side surface of the chamber 170. Hereinafter, a horizontal direction may be one direction on a plane perpendicular to the first axis AX1. The second portion 163 may have a bottom surface that is coplanar with the top surface of the chamber 170.

The third portion 165 of the window electrode 160 may extend from the second portion 163 in a direction parallel to the first axis AX1. For example, an extended length of the third portion 165 in the direction parallel to the first axis AX1 may be greater than that of the second portion 163 extending in the direction parallel to the first axis AX1. The third portion 165 may be spaced apart from the side surface of the chamber 170. The third portion 165 may have a bottom surface disposed at a level lower than each of the top surface of the chamber 170 and the bottom surface of the second portion 163. When the third portion 165 is not provided, insulating characteristics of the chamber 170 may be deteriorated because an electric field is concentrated on and thus an electric charge is easily accumulated on a portion at which the window electrode 160 contacts the top surface of the chamber 170 That is, the third portion 165 spaced apart from the side surface of the chamber 170 and extending in parallel to the first axis AX1 may prevent deterioration of the insulating characteristics of the chamber 170.

Figure 4:
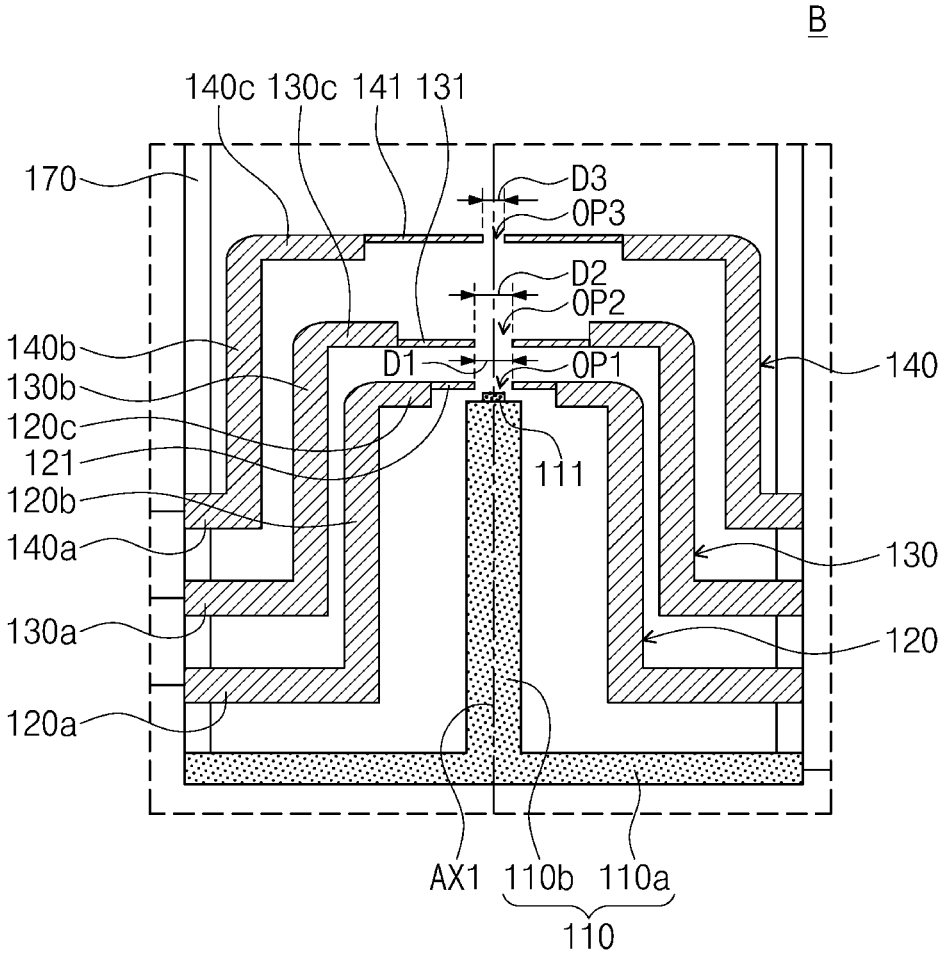
FIG. 4 is an enlarged cross-sectional view illustrating a portion B of FIG. 1.

FIG. 4 is an enlarged cross-sectional view illustrating a portion B of FIG. 1.

Referring to FIG. 4, the gate electrode 120, the first focusing electrode 130, and the second focusing electrode 140 may be disposed on the side surface of the chamber 170. Here, unlike as illustrated, only one focusing electrode may be provided, or three or more focusing electrodes may be provided.

Each of the gate electrode 120, the first focusing electrode 130, and the second focusing electrode 140 may include portions extending perpendicularly to the first axis AX1 and a portion extending in parallel to the first axis AX1. The gate electrode 120, the first focusing electrode 130, and the second focusing electrode 140 may have substantially similar shapes to each other.

The gate electrode 120 may include a first portion 120*a* and a third portion 120*c*, which extend perpendicularly to the first axis AX1, and a second portion 120*b* extending in parallel to the first axis AX1. The first portion 120*a* may be fixed to the side surface of the chamber 170. The first portion 120*a* may extend from the side surface of the chamber 170 in a direction toward the first axis AX1. The second portion 120*b* may extend from one end of the first portion 120*a* in a direction away from the cathode electrode 110. The one end of the first portion 120*a*, which contacts the second portion 120*b*, may not contact the chamber 170. The third portion 120*c* may extend from the second portion 120*b* in a direction toward the first axis AX1. Here, unlike as illustrated, the gate electrode 120 may have a plate shape extending perpendicularly to the first axis AX1 from the side surface of the chamber 170. The gate electrode 120 may further include a first protruding portion 121 provided on a side surface of the third portion 120*c*. The first protruding portion 121 may extend from the side surface of the third portion 120*c* in a direction toward the first axis AX1. The first protruding portion 121 may have a vertical thickness less than that of the third portion 120*c*. As the first protruding portion 121 has a thickness less than that of the third portion 120*c*, a focusing efficiency of the electronic beam may further increases. Also, the first opening OP1 may be a space surrounded by the first protruding portion 121. The first opening OP1 may expose the emitter 111. The first opening OP1 may have a first width D1 greater than a horizontal width of the emitter 111. Hereinbefore, features described with respect to the shape of the gate electrode 120 may be applied to the shape of each of the first focusing electrode 130 and the second focusing electrode 140 in the substantially same manner.

Hereinafter, a position relationship and a different point between the gate electrode 120, the first focusing electrode 130, and the second focusing electrode 140 will be described.

The gate electrode 120, the first focusing electrode 130, and the second focusing electrode 140 may be spaced apart from each other. That is, the gate electrode 120, the first focusing electrode 130, and the second focusing electrode 140 may be electrically separated from each other. Also, the gate electrode 120 may be spaced apart from the cathode electrode 110, and the second focusing electrode 140 may be spaced apart from the anode electrode 150.

The side surface of the third portion 120*c* of the gate electrode 120 may be closer to the first axis AX1 than a side surface of a third portion 130*c* of the first focusing electrode 130. Also, the side surface of the third portion 130*c* of the first focusing electrode 130 may be closer to the first axis AX1 than a side surface of a third portion 140*c* of the second focusing electrode 140 The first to third openings OP1, OP2, and OP3 may be provided in spaces surrounded by the first to third protruding portions 121, 131, and 141 of the gate electrode 120, the first focusing electrode 130, and the second focusing electrode 140, respectively. The first to third openings OP1, OP2, and OP3 may expose the emitter 111. Thus, the electronic beam emitted from the emitter 111 may travel along the first axis AX1. Here, the second opening OP2 may have a second width D2 greater than a third width D3 of the third opening OP3. Thus, the electronic beam passing through the second opening OP2 may be further focused while passing through the third opening OP3.

The X-ray tube according to the embodiment of the inventive concept may minimize the distance between the subject and the anode electrode as the window is grounded, and effectively focus the electronic beam emitted from the emitter by including the gate electrode and the focusing electrodes.

Thus, the X-ray tube according to the embodiment of the inventive concept may obtain the high resolution image with the sufficient X-ray dose.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed. Thus, the above-disclosed embodiments are to be considered illustrative and not restrictive.

What is claimed is:

1. An X-ray tube comprising:

a chamber having a hollow pillar shape using a first axis as a central axis;

a cathode electrode disposed on a bottom surface of the chamber;

an emitter provided at a position at which the cathode electrode meets the first axis;

an anode electrode comprising a through-hole using the first axis as a central axis and a target layer inclined to the first axis;

a gate electrode disposed between the cathode electrode and the anode electrode and having an opening configured to expose the emitter;

a focusing electrode disposed between the gate electrode and the anode electrode;

a window spaced apart from the target layer of the anode electrode; and a window electrode provided on a top surface of the chamber to fix a side surface of the window, wherein the window electrode is grounded.

2. The X-ray tube of claim 1, wherein the focusing electrode is provided in plurality, and each of the focusing electrodes has an opening configured to expose the emitter.

3. The X-ray tube of claim 2, wherein the focusing electrodes and the gate electrode comprise protruding portions provided on side surfaces thereof, respectively, wherein the protruding portions surround the openings, respectively, and each of the protruding portions has a thickness less than that of each of the focusing electrodes and the gate electrode.

4. The X-ray tube of claim 1, wherein the cathode electrode comprises a first portion having a plane shape perpendicular to the first axis and a second portion protruding from the first portion in a direction parallel to the first axis.

5. The X-ray tube of claim 4, wherein the emitter is provided on a top surface of the second portion of the cathode electrode.

6. The X-ray tube of claim 4, further comprising a control circuit unit connected to the first portion of the cathode electrode, wherein the control circuit unit comprises at least one transistor to which a signal is applied.

7. The X-ray tube of claim 1, wherein the anode electrode comprises:

a first portion having a plane shape perpendicular to the first axis;

a second portion having a hollow pillar shape configured to surround the through-hole;

a third portion provided on one portion of a top surface of the second portion, wherein the through-hole has a lower opening defined at a central portion of the first portion, the through-hole has an upper opening defined at a central portion of the second portion, the second portion has a top surface inclined to a top surface of the first portion, and the target layer is provided on a side surface of the third portion.

8. The X-ray tube of claim 7, wherein the target layer has a target surface parallel to the side surface of the third portion, and the target surface is inclined to the first axis.

9. The X-ray tube of claim 1, wherein the target layer comprises at least one of tungsten (W) or molybdenum (Mo).

10. The X-ray tube of claim 1, wherein the window electrode comprises:

a first portion having a plane shape perpendicular to the first axis;

a second portion disposed between the first portion and the top surface of the chamber; and a third portion extending from the second portion in a direction parallel to the first axis, wherein the first portion surrounds the window, and the third portion is spaced apart from a side surface of the chamber.

11. The X-ray tube of claim 10, wherein the window has a thickness less than that of the first portion, and an extended length of the third portion in the direction parallel to the first axis is greater than that of the second portion in the direction parallel to the first axis.

12. The X-ray tube of claim 1, wherein the window comprises at least one of beryllium (Be), copper (Cu), aluminum (Al), or molybdenum (Mo).

13. The X-ray tube of claim 1, wherein the chamber comprises an aluminum oxide ($Al_2O_3$).

14. An X-ray tube comprises:

a chamber having a hollow pillar shape;

a cathode electrode disposed on a bottom surface of the chamber;

an emitter provided on the cathode electrode and configured to emit an electronic beam in a direction perpendicular to a top surface of the cathode electrode;

a gate electrode having a first opening through which the electronic beam passes;

a first focusing electrode having a second opening through which the electronic beam passes;

a second focusing electrode having a third opening through which the electronic beam passes;

an anode electrode comprising a through-hole through which the electronic beam passes and a target layer configured to collide with the electronic beam to emit an X-ray;

a window through which the X-ray is discharged to the outside of the chamber; and a window electrode configured to fix a side surface of the window, wherein a width of the second opening is greater than a width of the third opening.

15. The X-ray tube of claim 14, wherein centers of the first to third openings, a central axis of the through-hole, and a center of the target layer are aligned on a path of the electronic beam perpendicular to the top surface of the cathode electrode.

16. The X-ray tube of claim 14, wherein the anode electrode is fixed to a side surface of the chamber, the target layer is provided on a side surface of one portion of the anode electrode, and the target layer has a target surface inclined to a path of the electronic beam perpendicular to the top surface of the cathode electrode.

17. The X-ray tube of claim 14, wherein the window is spaced apart from the target layer, the window has a vertical thickness less than that of the window electrode, and the window electrode is grounded.

18. The X-ray tube of claim 14, wherein the window electrode covers a top surface of the chamber, and the window electrode comprises one portion extending in a direction toward the cathode electrode in the chamber, wherein the one portion is spaced apart from a side surface of the chamber, and the one portion has a bottom surface disposed at a level lower than the top surface of the chamber.

19. The X-ray tube of claim 14, wherein the gate electrode, the first focusing electrode, and the second focusing electrode comprise first to third protruding portions configured to surround the first to third openings, respectively, and the gate electrode, the first focusing electrode, and the second focusing electrode are spaced apart from each other.

20. The X-ray tube of claim 14, wherein the gate electrode, the first focusing electrode, the second focusing electrode, and the anode electrode are connected to first to fourth voltage sources, respectively, and the fourth voltage source has a higher voltage than each of the first to third voltage sources.

* * * * *